US009611081B2

(12) United States Patent
Valus et al.

(10) Patent No.: US 9,611,081 B2
(45) Date of Patent: Apr. 4, 2017

(54) SCAVENGING OXYGEN

(75) Inventors: Ronald James Valus, Valley View, OH (US); Mark Rule, Roswell, GA (US); Andrew Stuart Overend, Bolton (GB); Christine Leeming, Cheshire (GB); Steven Burgess Tattum, Cheshire (GB); James Stuart Leeming, legal representative, Cheshire (GB)

(73) Assignee: COLORMATRIX HOLDINGS, INC., Wilmington, DE (US)

( * ) Notice: Subject to any disclaimer, the term of this patent is extended or adjusted under 35 U.S.C. 154(b) by 480 days.

(21) Appl. No.: 13/263,806

(22) PCT Filed: Apr. 9, 2010

(86) PCT No.: PCT/EP2010/054733

§ 371 (c)(1),
(2), (4) Date: Jan. 30, 2012

(87) PCT Pub. No.: WO2010/115992

PCT Pub. Date: Oct. 14, 2010

(65) Prior Publication Data

US 2012/0118764 A1 May 17, 2012

Related U.S. Application Data

(60) Provisional application No. 61/167,919, filed on Apr. 9, 2009.

(51) Int. Cl.
*B65D 81/24* (2006.01)
*B23P 11/00* (2006.01)
(Continued)

(52) U.S. Cl.
CPC ..... *B65D 51/244* (2013.01); *B65D 51/00* (2013.01); *B65D 81/267* (2013.01); *Y10T 29/49826* (2015.01)

(58) Field of Classification Search
CPC ..... B32B 5/16; B32B 5/22; B32B 2307/74; B65D 81/266; B65D 81/267; B65D 81/268;
(Continued)

(56) References Cited

U.S. PATENT DOCUMENTS 3,419,400 A * 12/1968 Hayhurst et al. ..... 426/124
3,712,848 A 1/1973 Casey, Jr. et al.
(Continued)

FOREIGN PATENT DOCUMENTS

EP 0066199 A2 12/1982
EP 0328337 A1 8/1989
(Continued)

OTHER PUBLICATIONS

European Search Report from EP 12 18 1561.
European Search Report from EP 12 18 1527.
European Search Report from EP 12 18 1552.

*Primary Examiner* — Yan Lan
(74) *Attorney, Agent, or Firm* — Fay Sharpe LLP

(57) ABSTRACT

A closure 40 for a container body includes a liner 46 which incorporates a hydrogen generating device comprising a hydride which generates hydrogen on contact with moisture. The liner may be an interference fit within the body 42. The liner 46 and other liners described may include control means for controlling passage of moisture to the hydrogen generating means and/or sealing means for sealing the closure to a container. In use, with the closure secured to a container, water vapor passes into liner 46 and contacts the hydride which generates hydrogen. A reaction between hydrogen and oxygen which has passed into the container takes place, catalysed by a catalyst, and water is produced. Thus, oxygen is scavenged.

20 Claims, 6 Drawing Sheets

(51) Int. Cl.
*B65D 51/24* (2006.01)
*B65D 51/00* (2006.01)
*B65D 81/26* (2006.01)

(58) Field of Classification Search
CPC . B65D 51/244; B65D 51/00; B29C 45/14811; B29C 63/0047; Y02E 60/364; A23L 3/3427; A23L 3/3436; C01B 3/065; C01B 3/10; C08K 3/12; Y10T 29/49826
USPC ..... 428/35.7, 36.6; 215/341, 329, 253, 261; 220/212, 521; 206/213.1
See application file for complete search history.

(56) References Cited

U.S. PATENT DOCUMENTS

| | | | | |
|---|---|---|---|---|
| 4,279,350 | A | 7/1981 | King | |
| 5,057,365 | A * | 10/1991 | Finkelstein et al. | 428/344 |
| 5,381,914 | A | 1/1995 | Koyama et al. | |

FOREIGN PATENT DOCUMENTS

| | | | |
|---|---|---|---|
| EP | 1 539 882 B1 | | 11/2006 |
| GB | 1005651 | | 9/1965 |
| GB | 1069929 | | 5/1967 |
| GB | 1188170 | | 4/1970 |
| WO | 9722469 | | 6/1997 |
| WO | 9815966 | | 4/1998 |
| WO | WO 99/02419 | | 1/1999 |
| WO | 9905922 | | 11/1999 |
| WO | WO2008/090354 | * | 7/2008 |

* cited by examiner

SCAVENGING OXYGEN

CROSS-REFERENCE TO RELATED APPLICATIONS

This application is National Stage Entry of international application number PCT/EP2010/054733, filed Apr. 9, 2010, which claims priority from U.S. Provisional Application Serial No. 61/167,919, filed Apr. 9, 2009, the disclosures of which are incorporated by reference in their entireties.

BACKGROUND

This invention relates to scavenging oxygen and particularly, although not exclusively, relates to the scavenging of oxygen in containers, for example food or beverage containers.

Polymers such as poly(ethylene terephthalate) (PET) are versatile materials that enjoy wide applicability as fibers, films, and three-dimensional structures. A particularly important application for polymers is for containers, especially for food and beverages. This application has seen enormous growth over the last 20 years, and continues to enjoy increasing popularity. Despite this growth, polymers have some fundamental limitations that restrict their applicability. One such limitation is that all polymers exhibit some degree of permeability to oxygen. The ability of oxygen to permeate through polymers such as PET into the interior of the container is a significant issue, particularly for foods and beverages that are degraded by the presence of even small amounts of oxygen. For the purpose of this disclosure, permeable means diffusion of small molecules through a polymeric matrix by migrating past individual polymer chains, and is distinct from leakage, which is transport through macroscopic or microscopic holes in a container structure.

Besides food and beverages, other products affected by oxygen include many drugs and pharmaceuticals, as well as a number of chemicals and even electronics. In order to package these oxygen-sensitive products, brand owners have historically relied on the use of glass or metal packaging. More recently, brand owners have begun to package their products in plastic packages which incorporate either passive barriers to oxygen and/or oxygen scavengers. Generally, greater success has been achieved utilizing oxygen scavengers; however, oxygen scavenging materials heretofore have suffered from a number of issues. In particular, oxygen scavengers utilized to date rely on the incorporation of an oxidizable solid material into the package. Technologies utilized include oxidation of iron (incorporated either in sachets or in the container sidewall), oxidation of sodium bisulfite, or oxidation of an oxidizable polymer (particularly poly(butadiene) or m-xylylenediamine adipamide). All of these technologies suffer from slow rates of reaction, limited capacity, limited ability to trigger the scavenging reaction at the time of filling the container, haze formation in the package sidewall, and/or discoloration of the packaging material. These problems have limited the use of oxygen scavengers in general, and are especially significant for transparent plastic packaging (such as PET) and/or where recycling of the plastic is considered important.

It is an object of the present invention to address problems associated with scavenging oxygen.

BRIEF DESCRIPTION

According to a first aspect of the invention, there is provided a closure for a container body, the closure comprising a hydrogen generating means which includes an active material arranged to generate molecular hydrogen on reaction with moisture.

Preferably, the closure includes a closure body which may be arranged to overly an opening in a container body. The closure body suitably includes means for securing, preferably releasably securing, the closure on a container body. Said means for securing may comprise a screw-threaded area suitably associated with an inwardly facing wall of the closure body. Said means for securing may be arranged to cooperate with a corresponding region on an outside wall of a neck of a container body.

The closure body suitably includes a top wall which is suitably circular in cross-section (although it may have another shape, such as a hexagonal shape) and is suitably arranged to be superimposed and/or overlie in use an opening in a container body with which the closure may cooperate. The closure body preferably includes a skirt (suitably having a circular cross-section) depending from the top wall, wherein preferably an inwardly facing wall of the skirt includes the aforementioned means for securing. Preferably, said means for securing, for example said screw-threaded area, extends from a free edge of the skirt towards the top wall. Preferably said closure body including said skirt and said means for securing define a unitary member. Said closure body may be produced in a moulding process, for example an injection moulding process, using a polymeric material such as a polyolefin. Alternatively, said closure body may be made from metal. Metal closures may be used for plastics wine bottles.

The closure body suitably defines a cap arranged to be secured, preferably releasably secured, to a container body.

The hydrogen generating means may be arranged to slowly release molecular hydrogen inside the container over an extended period of time. In the presence of a suitable catalyst, the molecular hydrogen will react with any oxygen present in the interior of the container or in the container wall. Preferably, the rate of hydrogen release is tailored to match the rate of oxygen ingress into the container. In addition, it is preferable for there to be an initial relatively rapid release of hydrogen, followed by a slow continual release over a period of months or even years. Furthermore, it is preferred that substantial release of hydrogen reliably begins only when the package is filled. Finally, it is preferable that the substance releasing hydrogen does not adulterate the contents of the container.

Said hydrogen generating means may comprise a matrix in which said active material is associated, for example embedded or preferably dispersed. Suitable polymeric matrix materials can be selected based on the solubility of moisture in the bulk polymer. Suitable polymeric matrix materials include but are not limited to polyolefins, low density polyethylene, high density polyethylene, polypropylene, styrene-ethylene-butylene (SEBS) copolymers, Nylon 6, styrene, styrene-acrylate copolymers and ethylene vinyl acetate. The ratio of the weight of active material to matrix material may be at least 0.01, preferably at least 0.02. The matrix may be a polymeric matrix and said active material may be dispersed therein. In general, once an active material is dispersed into a polymer, the rate of release of hydrogen is limited by either the permeation rate of water into the polymeric matrix and/or by the solubility of water in the chosen matrix. Thus, selection of polymeric materials based on the permeability or solubility of water in the polymer allows one to control the rate of release of molecular hydrogen from active materials. However, by selection of other appropriate control means (as described hereinafter), the rate determining step for release of hydrogen may be determined by properties of said control means.

The polymeric matrix may include at least 1 wt % of active material, preferably at least 2 wt %. The polymeric matrix may include less than 70 wt % of active material. Suitably, the polymeric matrix includes 1-50 wt %, preferably 2-40 wt % of active material and more preferably 4-30%. The balance of material in the polymeric matrix may predominantly comprise a said polymeric material.

Said active material may comprise a metal and/or a hydride. A said metal may be selected from sodium, lithium, potassium, magnesium, zinc or aluminum. A hydride may be inorganic, for example it may comprise a metal hydride or borohydride; or it may be organic.

Active materials suitable for the release of molecular hydrogen as a result of contact with water include but are not limited to: sodium metal, lithium metal, potassium metal, calcium metal, sodium hydride, lithium hydride, potassium hydride, calcium hydride, magnesium hydride, sodium borohydride, and lithium borohydride. While in a free state, all of these substances react very rapidly with water; however, once embedded into a polymeric matrix, the rate of reaction proceeds with a half-life measured in weeks to months.

Other active substances may include organic hydrides such as tetramethyl disiloxane and trimethyl tin hydride, as well as metals such as magnesium, zinc, or aluminum. Where the rate of reaction between the active material and water is too slow, the addition of hydrolysis catalysts and/or agents are explicitly contemplated. For example, the rate of hydrolysis of silicon hydrides may be enhanced by the use of hydroxide or fluoride ions, transition metal salts, or noble metal catalysts.

It is also contemplated that the active material may also be the polymeric matrix. For example, polymeric silicon hydrides such as poly(methylhydro)siloxane provide both a polymeric matrix and an active substance capable of releasing molecular hydrogen when in contact with moisture. The active material may be a polymer bound material such as a polymer bound borohydride.

When hydrogen generation occurs by reaction of the active substance with water, initiation of substantial hydrogen generation will occur only when the hydrogen generator is placed in a moisture-containing environment such as that found in most oxygen-sensitive foods and beverages. Thus initiation of hydrogen generation generally will coincide with the filling of the container and/or placement of the closure on the container. In order to prevent or minimize hydrogen generation before this time, it is sufficient to minimize contact of the hydrogen generator with moisture. Unlike exclusion of molecular oxygen, exclusion of moisture is readily achieved by a number of methods, including but not limited to packaging the hydrogen generator and/or the structures containing the hydrogen generator in metal foil, metallized plastic, or polyolefin bags. For example, bulk packaging of closures containing hydrogen generating means in sealed polyethylene bags is an expedient way of limiting hydrogen generation prior to placement of the individual closures onto container bodies. Another method to limit contact of the hydrogen generator with moisture prior to placement of the individual closures onto container bodies is to place one or more dessicants inside the packaging with the closures.

Selection of suitable active substances for incorporation into a polymeric matrix can be based on a number of criteria, including but not limited to cost per kilogram, grams of $H_2$ generated per gram of active substance, thermal and oxidative stability of the active substance, perceived toxicity of the material and its reaction byproducts, and ease of handling prior to incorporation into a polymeric matrix. Of the suitable active substances, sodium borohydride is exemplary because it is commercially available, thermally stable, of relatively low cost, has a low equivalent molecular weight, and produces innocuous byproducts (sodium metaborate).

Said hydrogen generating means is preferably positioned adjacent a top wall of the closure (suitably adjacent an inwardly facing surface of the top wall) and is suitably secured relative thereto. Said hydrogen generating means is preferably positioned so that it extends to a position which is less than 10 mm, suitably less than 8 mm, preferably less than 7 mm, more preferably less than 6 mm, especially less than 5 mm from an inwardly facing surface of the top wall of the closure.

Said hydrogen generating means preferably extends between a depending skirt of the closure. Suitably, the hydrogen generating means extends across at least 50% (suitably at least 60%, preferably at least 70%, more preferably at least 80%, especially at least 90%) of the length of the internal diameter of the depending skirt. In some cases, it may extend 95% or about 100% of said diameter. References to the internal diameter are preferably to the maximum internal diameter.

Said hydrogen generating means may have a length of at least 5 mm, preferably at least 10 mm, more preferably at least 15 mm, especially at least 20 mm. The length may be less than 100 mm, less than 80 mm, less than 45 mm, less than 40 mm, less than 35 mm, or less than 30 mm. The length is suitably the maximum dimension of the hydrogen generating means.

Said hydrogen generating means may have a width (which is suitably the minimum dimension of the hydrogen generating means in one dimension) of less than 7 mm, suitably less than 5 mm, preferably less than 4 mm, more preferably less than 3 mm.

Said hydrogen generating means may be a part of an assembly which is part of the closure and is suitably secured relative to the closure body described. Said assembly preferably comprises said hydrogen generating means in combination with one or more other components selected from control means for controlling passage of moisture, in use, from a container to the hydrogen generating means and sealing means for sealing the closure to a container.

Said control means is preferably arranged to control passage of moisture suitably so as to reduce the rate of hydrogen generation by said hydrogen generating means compared to the rate in the absence of said control means. In this case, the control means suitably defines the rate determining step for passage of moisture to the active material of the hydrogen generating means, rather than the rate determining step being defined by other features of the hydrogen generating means, for example the properties of a matrix material with which the active material may be associated.

Providing a control means as described introduces substantial flexibility which allows control of the rate of production of hydrogen by the hydrogen generating means and tailoring of the time over which hydrogen is generated, which determines the shelf-life of the container. For example, to achieve a long shelf-life a relatively large amount of active material may be associated with a matrix and by controlling passage of moisture to the hydrogen generating means, the rate of hydrogen generation is controlled as is the rate of consumption of the active material. In contrast, in the absence of the control means, the relatively large amount of active material would produce hydrogen at a quicker rate and would be consumed quicker meaning the shelf-life of the container would be less.

Suitably, the only path for passage of moisture to the hydrogen generating means is via said control means. Said control means preferably defines an uninterrupted barrier between the hydrogen generating means and a source of moisture in the container.

Unless otherwise stated, water permeability described herein is measured using (American Society for Testing Materials Annual Book of Standards) ASTM procedure E96 Procedure E at 38° C. and relative humidity of 90%.

The rate of passage of moisture through the control means, towards the hydrogen generating means, is preferably slower than the rate of passage of water through the hydrogen generating means (e.g. through a matrix material thereof as described below). Preferably, to achieve the aforesaid, the ratio of the water vapour permeability ($g \cdot mm/m^2 \cdot day$) of the control means to the water vapour permeability of the matrix is 1 or less, preferably 0.75 or less, more preferably 0.5 or less.

Preferably said control means comprises a material, for example a polymeric material, which has a water vapour permeability ($g \cdot mm/m^2 \cdot day$) which is less than the water vapour permeability of said matrix material (preferably a said polymeric matrix material present in the greatest amount if more than one polymeric matrix material is included in said matrix) of said hydrogen generating means. The ratio of the water vapour permeability of the material, for example polymeric material, of said control means to the water vapour permeability of a said matrix material (preferably a said polymeric matrix material present in the greatest amount if more than one polymeric matrix material is included in said matrix) of said hydrogen generating means may be 1 or less, preferably 0.75 or less, more preferably 0.5 or less.

Said control means may comprise a layer of material, for example polymeric material, having a water vapour permeability of less than 2.0 $g \cdot mm/m^2 \cdot day$, suitably less than 1.5 $g \cdot mm/m^2 \cdot day$, preferably less than 0.8 $g \cdot mm/m^2 \cdot day$, more preferably less than 0.4 $g \cdot mm/m^2 \cdot day$.

Said control means may comprise a layer of polymeric material selected from HDPE, PP, LDPE, PET, EVA, SEBS and Nylon (e.g. Nylon-6).

Said control means may comprise a layer of material, for example polymeric material, having a thickness of at least 0.010 mm, preferably at least 0.025 mm, more preferably at least 0.045 mm. The thickness may be less than 0.5 mm, 0.2 mm or 0.1 mm.

Various means may be used to define control means for controlling passage of moisture. In one embodiment, said control means may comprise a single layer of material (e.g. sheet material) which is suitably positioned between said hydrogen generating means and a source of moisture in the container. Said single layer of material suitably comprises a polymeric material, as aforesaid The single layer may have a thickness of at least 0.010 mm, preferably at least 0.025 mm, more preferably at least 0.045 mm. The thickness may be less than 0.5 mm, 0.2 mm or 0.1 mm.

The material, for example polymeric material of the control means is suitably permeable to hydrogen and water vapour. Preferably, it is impermeable to by-products of the hydrogen generating means which could migrate into the container.

In another embodiment, said control means may comprise a plurality of layers which are suitably juxtaposed for example so they make face to face contact. The layers may be secured, for example laminated, to one another so that, together, they define a unitary control means, albeit comprising a plurality of layers. The plurality of layers are suitably positioned between said hydrogen generating means and a source of moisture in the container. Preferably, the rate of passage of water vapour through at least one of the layers is slower than the rate of passage of water vapour through the matrix of the hydrogen generating means.

A said sealing means of said assembly is preferably annular. It is preferably arranged to sealingly contact a top of a container body in use, to seal the closure to the container body so that substantially no oxygen can pass from a position outside the container body through any gap between the closure and the container body.

Said sealing means may include a sealing face which suitably extends in a direction which is transverse to the direction in which the closure is arranged to be removed from a container body in use. A sealing face of the sealing means suitably extends radially to a rotational axis of the closure. Said sealing face of the sealing means preferably extends in substantially the same direction as the top wall of the closure body. A sealing face of the sealing means is preferably arranged to contact a lip of a container body. It is preferably arranged to contact an annular surface of the container body which faces outwardly away from an opening in the container body with which the closure may cooperate.

Said sealing means is preferably resilient. It may be compressible. It may include a polymeric material for example a thermoplastic elastomer and/or a compressible foam material. The sealing means may completely overlie the hydrogen generating means.

Said assembly may be secured to the closure body by mechanical means and/or by other means. Preferred mechanical means include the assembly being a friction or interference fit within the closure body. In this regard, the assembly may comprise a disc, which is suitably of circular cross-section, and is preferably arranged to be a friction or interference fit within a depending skirt of the closure. Suitably, the assembly is arranged to abut the depending skirt and abut an inwardly facing surface of a top wall of the closure. The disc may have a diameter of at least 5 mm, at least 10 mm or at least 20 mm. The thickness may be at least 0.1 mm, preferably at least 0.3 mm, especially at least 0.6 mm. The disc may have a diameter of at less than 120 mm, less than 100 mm, or less than 80 mm; and may have a thickness of less than 6 mm, less than 4 mm, or less then 2 mm.

Other means for securing the assembly to the closure body may include use of adhesives or other means for adhering the assembly to the body. One such other means may involve heating the closure body and/or assembly so one or both softens or locally melts so that on cooling the two parts are secured to one another. For example, the assembly may be moulded, for example compression moulded, to the closure body. Parts of the assembly may be sequentially moulded to the closure body to define the assembly.

Said assembly may comprise a first layer comprising (preferably consisting essentially of) said hydrogen generating means and a second layer comprising a control means and/or a sealing means. In some cases, the second layer may include both control means and sealing means. Said second layer is preferably resilient and/or compressible. Said second layer may comprise a control means as described. Said second layer is preferably arranged to be closer to the contents of the container in use compared to said first layer.

In some embodiments, the assembly may include a said first layer in combination with a second layer which is suitably compressible and defines said sealing means, in combination with a third layer which comprises a control means as described. Optionally, the assembly may include a gas barrier layer, suitably arranged to be substantially impermeable to oxygen. Such a layer may be further away from the contents of a container in use compared to said first layer.

When an assembly comprises first and second layers and optional other layers, the assembly may comprise a laminate. Said first and second layers (preferably each layer) may have the same width and shape, although the thickness may vary from layer to layer. The assembly may suitably be secured in the closure body by mechanical means, for example by being a friction or interference fit as described.

In some embodiments, the assembly may comprise a moulding which comprises a first region comprising (preferably consisting essentially of) said hydrogen generating means and a second region comprising a control means and/or sealing means. In some cases the second region may include both control means and sealing means. Said second region is preferably resilient and/or compressible. Said second region may comprise a control means as described. Said second region is preferably arranged to be closer to the contents of a container in use compared to said first region. Said second region may define an annulus (suitably at its periphery) which is arranged to sealingly engage a container in use and a region adjacent the annulus which may be stepped from said annulus and/or may define a bulbous region which projects away from said annulus.

In some embodiments, the closure includes sealing means which are separate from, and suitably spaced from, the hydrogen generating means and/or said assembly as described. Such sealing means may comprise an annular collar extending downwardly, suitably from a top wall of the closure, wherein the sealing means may be arranged to abut an internal circumferential wall of a neck of a container body in use to provide a seal between said circumferential wall and the closure. Said sealing means may be a part which is moulded as part of the closure body and is suitably made from the same material as said closure body.

In one embodiment, the material of the closure body itself may incorporate hydrogen generating means.

In another embodiment, the closure may incorporate a catalyst for catalysing a reaction between hydrogen and oxygen as herein described.

According to a second aspect of the invention, there is provided an assembly as described according to the first aspect which comprises a said hydrogen generating means in combination with one or more other components selected from control means for controlling passage of moisture, in use, from a container to the hydrogen generating means and sealing means for sealing the closure to a container body.

Said assembly is preferably arranged to be secured to a part of a closure.

According to a third aspect of the invention, there is provided a container comprising a closure according to the first aspect.

The closure is suitably sealingly engaged with a container body of the container. The closure is preferably releasably securable to the container body.

The container suitably includes a catalyst for catalyzing a reaction between molecular hydrogen generated by said hydrogen generating means and molecular oxygen. As a result, molecular oxygen in said container, for example which passes into said container through a wall thereof, may be scavenged, with water as a byproduct.

For purposes of this disclosure, a container includes any package that surrounds a product and that contains no intentional microscopic or macroscopic holes that provide for transport of small molecules between the interior and the exterior of the package. Said container includes a closure. For purposes of this disclosure, a catalyst includes any substance that catalyzes or promotes a reaction between molecular hydrogen and molecular oxygen.

The container may include a sidewall constructed from a composition that includes a polymer resin first component and a second component comprising a catalyst capable of catalyzing a reaction between molecular hydrogen and molecular oxygen.

Because the generated hydrogen will permeate through the container walls, the amount of hydrogen present within the container at any time is minimal. Moreover, the faster hydrogen is generated the faster it will permeate; hence significant increases in the rate of hydrogen generation (from, for example, increased container storage temperatures) will result in only modest increases in the concentration of hydrogen within the container. Because the permeability of hydrogen through a polymer is much greater than the permeability of oxygen, the amount of hydrogen in the headspace of the container may not need to exceed 4 volume percent, which is below the flammability limit for hydrogen in air. Furthermore, the solubility of hydrogen in food or beverages is low; hence at any time most of the hydrogen in the container will be in the headspace of the container. Hence, the amount of hydrogen that may be present within a container may be very small. For example, for a 500 ml PET beverage container with a 30 milliliter headspace volume and a 0.05 cc/package-day $O_2$ ingress rate, less than about 1 cc of hydrogen is needed within the container in order for the rate of $H_2$ permeation to be greater than the rate of oxygen ingress. In addition, the rate of $H_2$ generation would need to be only about 0.1-0.2 cc/day in order for enough hydrogen to be generated on an ongoing basis to react with most or all of the ingressing oxygen.

Because only small amounts of hydrogen need to be present inside the container in order to achieve high levels of oxygen scavenging, expansion and contraction of the container over time from the presence (or loss) of hydrogen is minimal. Consequently this technology is readily applicable to both rigid and flexible containers.

In order to facilitate the reaction between molecular hydrogen with molecular oxygen, a catalyst is desired. A large number of catalysts are known to catalyze the reaction of hydrogen with oxygen, including many transition metals, metal borides (such as nickel boride), metal carbides (such as titanium carbide), metal nitrides (such as titanium nitride), and transition metal salts and complexes. Of these, Group VIII metals are particularly efficacious. Of the Group VIII metals, palladium and platinum are especially preferred because of their low toxicity and extreme efficiency in catalyzing the conversion of hydrogen and oxygen to water with little or no byproduct formation. The catalyst is preferably a redox catalyst.

In order to maximize the efficiency of the oxygen scavenging reaction, it is preferable to locate the catalyst where reaction with oxygen is desired. For example, if the application requires that oxygen be scavenged before it reaches the interior of the container, incorporation of the catalyst in the package sidewall is desirable. Conversely, if scavenging of oxygen already present in the container is desired, it is generally preferable to locate the catalyst near or in the interior of the container. Finally, if both functions are desired, catalyst may be located both in the interior of the container and in the container walls. While the catalyst may be directly dispersed into the food or beverage, it is generally preferable that the catalyst be dispersed into a polymeric matrix. Dispersion of the catalyst into a polymeric matrix provides several benefits, including but not limited to minimization of food or beverage adulteration, minimization of catalyzed reaction between molecular hydrogen and food or beverage ingredients, and ease of removal and/or recycling of the catalyst from the food or beverage container.

A particular advantage of the present invention is that because of the extremely high reaction rates obtainable with a number of catalysts, very small amounts of catalyst may be required. A container may include 0.01 ppm to 1000 ppm, suitably 0.01 ppm to 100 ppm, preferably 0.1 ppm to 10 ppm, more preferably at least 0.5 ppm of catalyst relative to the weight of said container (excluding any contents thereof). In preferred embodiments, 5 ppm or less of catalyst is included. Unless otherwise stated reference to "ppm" refer to parts per million parts by weight.

The small amount of catalyst needed allows even expensive catalysts to be economical. Moreover, because very small amounts are required to be effective, there can be minimal impact on other package properties, such as color, haze, and recyclability. For example, when palladium is utilized as the catalyst, concentrations less than about 5 ppm of finely dispersed Pd may be sufficient to achieve acceptable rates of oxygen scavenging. In general, the amount of catalyst required will depend on and can be determined from the intrinsic rate of catalysis, the particle size of the catalyst, the thickness of the container walls, the rates of oxygen and hydrogen permeation, and the degree of oxygen scavenging required.

In order to maximize the efficacy of the catalyst, it is preferred that the catalyst be well dispersed. The catalyst can be either homogenous or heterogeneous. For homogeneous catalysts it is preferred that the catalysts be dissolved in a polymer matrix at a molecular level. For heterogeneous catalysts, it is preferred that the average catalyst particle size be less than 1 micron, more preferred that average catalyst particle size be less than 100 nanometers, and especially preferred than the average catalyst particle size be less than 10 nanometers. For heterogeneous catalysts, the catalyst particles may be free-standing, or be dispersed onto a support material such as carbon, alumina, or other like materials.

The method of incorporation of the catalyst is not critical. Preferred techniques result in a well dispersed, active catalyst. The catalyst can be incorporated into a polymeric matrix during polymer formation or during subsequent melt-processing of the polymer. It can be incorporated by spraying a slurry or solution of the catalyst onto polymer pellets prior to melt processing. It can be incorporated by injection of a melt, solution, or suspension of the catalyst into pre-melted polymer. It may also be incorporated by making a masterbatch of the catalyst with polymer and then mixing the masterbatch pellets with polymer pellets at the desired level before injection molding or extrusion.

In a preferred embodiment, the catalyst is incorporated into a wall of the container. It is preferably associated with, for example dispersed in, a polymer which defines at least part of the wall of the container. In a preferred embodiment, the catalyst is associated with material which defines at least 50%, preferably at least 75%, more preferably at least 90% of the area of the internal wall of the container.

In a preferred embodiment, the catalyst is distributed substantially throughout the entire wall area of a container, optionally excluding a closure thereof.

The containers contemplated in the present invention may be either of a monolayer or a multilayer construction. In a multi-layered construction, optionally one or more of the layers may be a barrier layer. A non-limiting example of materials which may be included in the composition of the barrier layer are polyethylene co-vinyl alcohols (EVOH), poly(glycolic acid), and poly(metaxylylenediamine adipamide). Other suitable materials which may be used as a layer or part of one or more layers in either monolayer or multilayer containers include polyester (including but not limited to PET), polyetheresters, polyesteramides, polyurethanes, polyimides, polyureas, polyamideimides, polyphenyleneoxide, phenoxy resins, epoxy resins, polyolefins (including but not limited to polypropylene and polyethylene), polyacrylates, polystyrene, polyvinyls (including but not limited to poly(vinyl chloride)) and combinations thereof. Furthermore glassy interior and/or exterior coatings ($SiO_x$ and/or amorphous carbon) are explicitly contemplated as barrier layers. All of the aforementioned polymers may be in any desired combination thereof. Any and all of these materials may also comprise the container closure.

In a preferred embodiment, the container includes walls defined by polyester, for example PET and preferably catalyst is dispersed within the polyester.

The shape, construction, or application of the containers used in the present invention is not critical. In general, there is no limit to the size or shape of the containers. For example, the containers may be smaller than 1 milliliter or greater than 1000 liter capacity. The container preferably has a volume in the range 20 ml to 100 liter, more preferably 100 ml to 5 liter. Similarly, there is no particular limit to the thickness of the walls of the containers, the flexibility (or rigidity) of the containers, or the intended application of the containers. It is expressly contemplated that the containers include but are not limited to sachets, bottles, jars, bags, pouches, pails, tubs, barrels, or other like containers. Furthermore, the container may be located in the interior of another container, or have one of more containers located in the interior of the container.

Said container may include a permeable wall comprising of one or more polymers that have in the absence of any oxygen scavenging a permeability between about $6.5\times10^{-7}$ $cm^3$-cm/($m^2$-atm-day) and about $1\times10^4$ $cm^3$-cm/($m^2$-atm-day).

It is generally desirable to tailor the length of time hydrogen will be released from the hydrogen generator to be similar to or greater than the desired shelf-life of the product that is to be protected from oxygen ingress. Tailoring the length of time hydrogen will be released can be done by adjusting properties of the control means and/or hydrogen generating means. It is also desirable to tailor the rate of hydrogen generation to be equal to or somewhat greater than two times the rate of oxygen ingress, since the overall reaction is $2H_2+O_2 \rightarrow 2H_2O$.

The hydrogen generating means is suitably arranged to generate hydrogen for an extended period of time, for example at least 1 month, preferably at least 3 month, more preferably at least 6 months, especially at least 12 months. The aforementioned periods may be assessed after storage at room temperature (22° C.) and ambient pressure.

It may also be preferred to scavenge oxygen that is initially present in the container or the food or beverage. To do so it is preferred that the hydrogen generator initially release hydrogen at an enhanced rate. In these instances, it is also preferred that a catalyst be located in or near the interior of the container.

It is expressly contemplated that there may be a plurality of hydrogen generators provided, each with independently controllable hydrogen generation rates. By providing a plurality of hydrogen generators, the rate of hydrogen generation within a container can be tailored to meet any desired profile. It is also contemplated that in addition to providing at least one hydrogen generator, molecular hydrogen may be added to the interior of the container at the time of sealing.

In a further embodiment, a closure which includes hydrogen generating means may be used to replace an existing closure of a container to increase the rate of hydrogen generation in the container and/or to provide a means of oxygen scavenging or enhanced oxygen scavenging in the container. For example, such a closure may replace an existing closure which has and never had any means of generating hydrogen—it may be a conventional inactive closure. This may provide a means for a customer to enhance domestic storage life of an oxygen sensitive product. Alternatively, such a closure may replace an existing closure which includes (or included) a means for generating hydrogen but wherein the rate is less than optimum, for example due to the age of the closure and/or the time it has been generating hydrogen.

When the existing closure replaced is one which has never had any means of generating hydrogen, said closure may incorporate both a means of generating hydrogen and a catalyst for catalyzing a reaction between molecular hydrogen and molecular oxygen. In this case, the closure may suitably be protected prior to use by means which prevents or restricts moisture access to the hydrogen generator. Such means may comprise a foil or other impermeable material which is associated with the closure and arranged to prevent passage of moisture to the hydrogen generator.

When an existing closure is replaced, the replacement closure may be similar to the closure removed. When the catalyst is located in a wall of the container, the closure may have no catalyst and may only include said means for generating hydrogen. Thus, in the latter case, the method may comprise renewing or recharging the hydrogen generating ability of a container by replacing an existing closure with a new closure which includes a means of generating hydrogen which is enhanced compared to the closure replaced.

In a preferred embodiment, the closure of the first aspect may be for a wine container. It may be for a bottle, for example a wine bottle. The container may have a volume of between 100 ml to 5000 ml, 100 ml to 2500 ml, suitably 700 to 1100 ml.

The closure may include a weakened area which may be arranged to allow the closure to split into two parts when a container carrying the closure is initially "opened" to allow access to the contents of the container. The weakened area may be arranged to allow part of the closure to be removed from the container whilst the remaining part of the closure may be arranged to remain fixed to the container, for example on a bottle neck. The provision of such an arrangement with a weakened area may provide the closure with a tamper evident function.

According to a fourth aspect of the invention, there is provided a method of manufacturing a closure of the first aspect comprising securing an assembly of the second aspect within a closure body.

According to a fifth aspect, there is provided a method of manufacturing a container which comprises securing a closure of the first aspect to a container body.

Any feature of any aspect of any invention or embodiment described herein may be combined with any feature of any aspect of any other invention described herein mutatis mutandis.

BRIEF DESCRIPTION OF THE DRAWINGS

Specific embodiments of the invention will now be described, by way of example, with reference to the accompanying drawings, in which.

In the figures, the same or similar parts are annotated with the same reference numerals.

DETAILED DESCRIPTION

Figure 1:
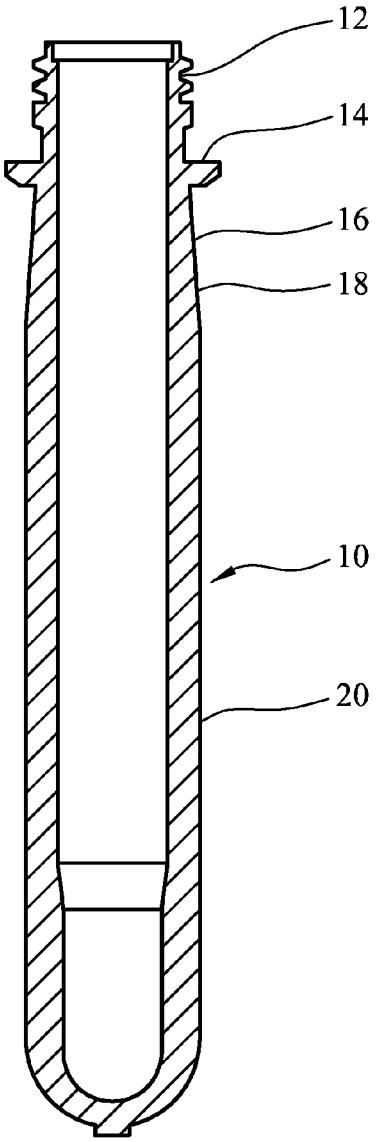
FIG. 1 is a cross-section through a preform.
Figure 2:
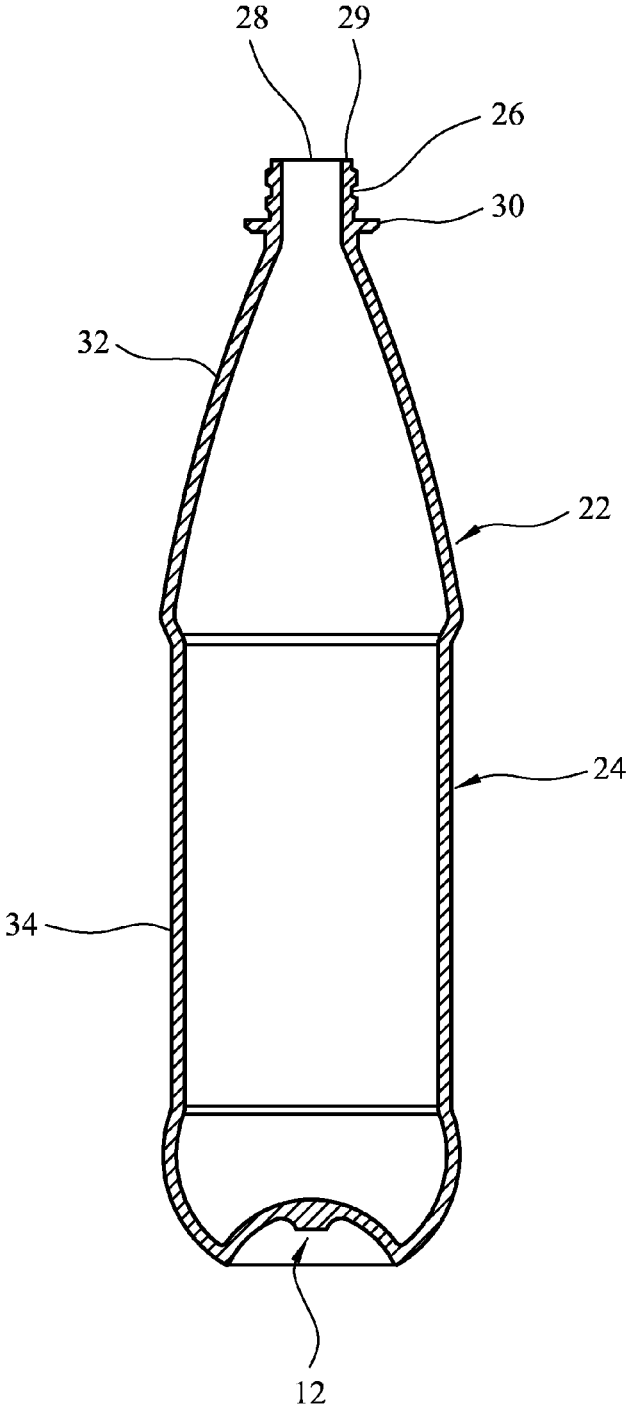
FIG. 2 is a cross-section through a bottle.
Figure 3:
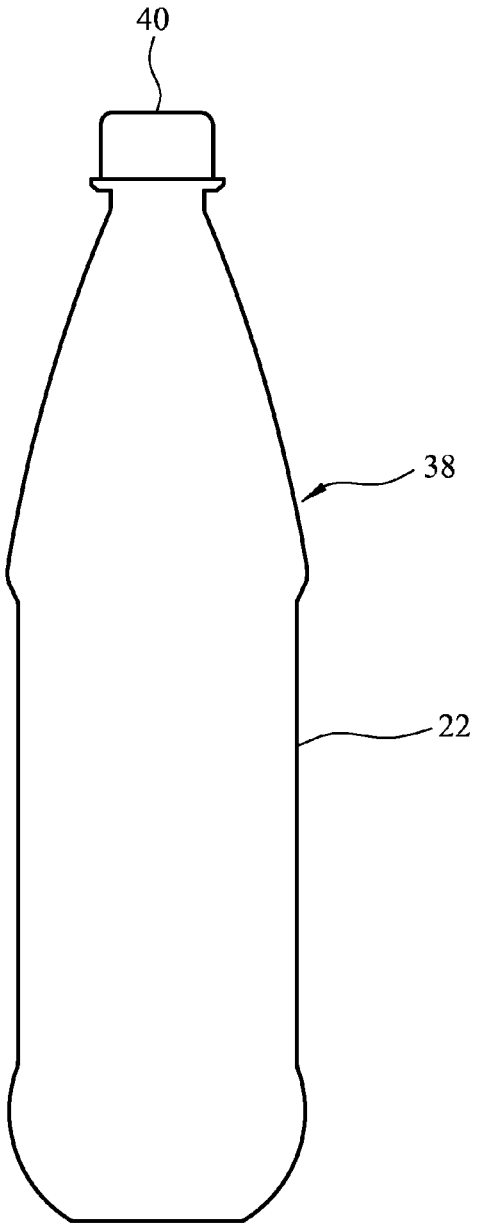
FIG. 3 is a side elevation of a bottle including a closure.

A preform 10 illustrated in FIG. 1 can be blow molded to form a container 22 illustrated in FIG. 2. The container 22 comprises a shell 24 comprising a threaded neck finish 26 defining a mouth 28, a capping flange 30 below the threaded neck finish, a tapered section 32 extending from the capping flange, a body section 34 extending below the tapered section, and a base 36 at the bottom of the container. The container 10 is suitably used to make a packaged beverage 38, as illustrated in FIG. 3. The packaged beverage 38 includes a beverage. The beverage may be a carbonated beverage or non-carbonated beverage. Examples of suitable beverages include soda, beer, wine, fruit juices, and water. In one particular embodiment, the beverage is an oxygen sensitive beverage. In another embodiment, the beverage is a vitamin C containing beverage such as a vitamin C containing fruit juice, a beverage which has been fortified with vitamin C, or a combination of juices in which at least one of the juices includes vitamin C. In this embodiment, the beverage is disposed in the container 22 and a closure 40 seals the mouth 28 of container 22.

Figure 4:
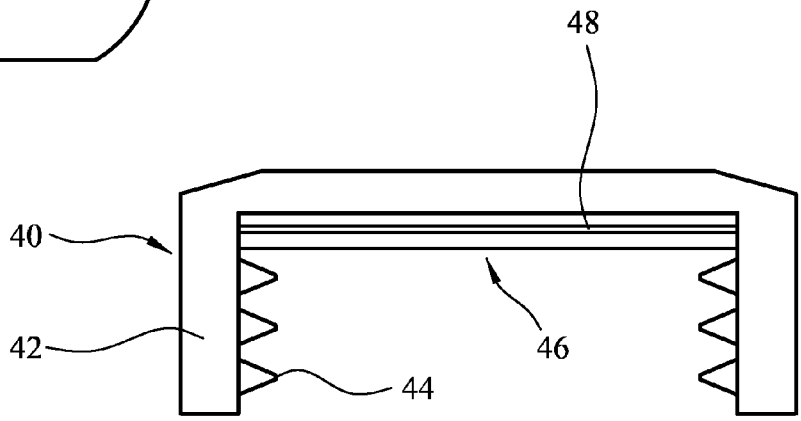
FIG. 4 is a closure, partly in cross-section.

Referring to FIG. 4, a circular cross-section closure 40 includes a body 42 with a screw-threaded portion 44 for screw-threadedly engaging the closure with threaded neck finish 26. Inwards of the portion 44 is a liner 46 comprising a hydrogen generating device which incorporates a hydride. The liner 46 is disc-shaped and is a friction fit within the body 42 of the closure which has a corresponding circular cross-section. Thus, the liner 46 is superimposed upon the circular cross-section, and its entire periphery extends to and contacts the circumferential wall of an inner part of the body 42 so that it effectively fills the inner part.

As an alternative to it being a friction fit, the liner may be an interfence fit within the body 42 and/or may be secured by adhesive or other means. If an adhesive is used, then there is no requirement for the liner to fill the inner part of the body 42.

The shell 24 of the container includes a catalyst. The catalyst may be dispersed in the polymer matrix, for example PET, which defines the shell 24 by injection molding polymeric matrix material and catalyst, for example a palladium compound, to define a preform 10 which is subsequently blow molded to define the container 22.

In use, with container 22 including a beverage and closure 40 in position, the headspace in the container will be saturated with water vapor. This vapor passes into liner 46 and contacts the hydride associated with the liner. As a result, the hydride produces molecular hydrogen which migrates into the polymer matrix of shell 24 and combines with oxygen which may have entered the container through its permeable walls. A reaction between the hydrogen and oxygen takes place, catalysed by the catalyst, and water is produced. Thus, oxygen which may ingress the container is scavenged and the contents of the container are protected from oxidation. The scavenging effect may be maintained for as long as hydrogen is produced in the container and such time may be controlled by inter alia varying the amount of hydride in the liner.

FIGS. 5 to 10 illustrate a range of different liners 46*a* to 46*e* which may be incorporated into the closure 40 of FIG. 4.

Figure 5:
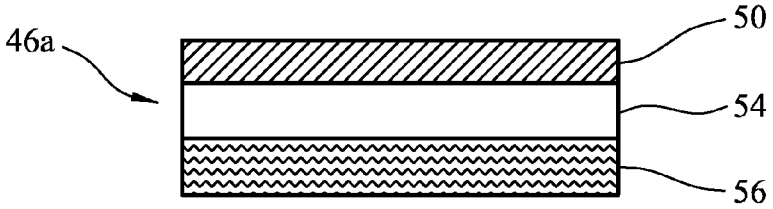
FIGS. 5 to 10 are cross-sections through liners which may be incorporated into closures.

Referring to FIG. 5, a three-layered liner 46*a* is shown which comprises an upper layer 50 which is arranged to make face-to-face contact with the inwardly facing wall 48 of the closure 40. Upper layer 50 may have multiple functions: it may be included to provide a gas barrier layer, and/or may be designed to be compressible by the introduction of any foamed construction and/or may be used to provide the structure with a smooth upwardly facing surface, and/or may be included to provide good adhesion to the inwardly facing wall 48. Optionally, upper layer 50 may be made from the same material as layer 56 if a symmetrical structure is required.

Layer 54 comprises a foamed layer which incorporates a hydride and is therefore arranged to generate hydrogen as described herein. In some cases, the hydride may be arranged to act as a blowing agent in the production of the foamed layer and then remaining hydride may be used to generate hydrogen which is used in scavenging oxygen. The foam layer is compressible and is thereby arranged to facilitate sealing engagement of the liner 46*a* with an upwardly facing edge 29 of the container.

Layer 56 has multiple functions. Firstly, it may act as a functional barrier layer, separating the active material from the beverage. Secondly, it may act as a moisture 'gate' (e.g. a control means hereinbefore described) where the rate of moisture ingress through this layer impacts on the hydrogen evolution rate from the active material, in combination with the polymer matrix inside which the active material is encapsulated. Layer 56 should allow water vapour, molecular hydrogen and molecular oxygen to pass through but should preferably not allow any hydrogen generator/by-products to pass out into the beverage. Thirdly, layer 56 may act to provide the necessary surface friction characteristics between the free face of layer 56 and the upwardly facing edge 29 of the container to ensure that application and removal torque properties are appropriate for the packaging.

Optionally, any one or layers 50, 54 and 56 may include a catalyst for catalysing the reaction between hydrogen and oxygen. Where a catalyst is included, it may be located in the layer(s) closer to the moisture source.

Figure 6:
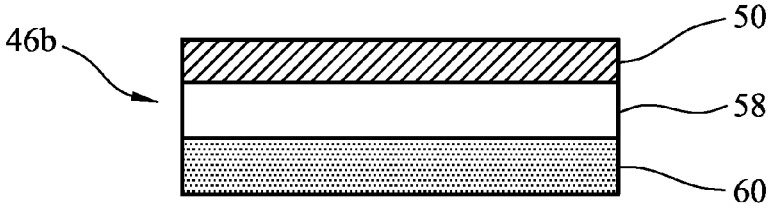

Referring to FIG. 6, layer 50 is as described with reference to FIG. 5. Layer 58 comprises an active hydride material encapsulated within a polymer matrix. This layer could also incorporate a catalyst for catalysing the reaction between hydrogen and oxygen. In this case, a closure incorporating liner 46*b* would provide all the components required for an oxygen scavenging reaction. The matrix polymer could be a variety of species, preferably LDPE or EVA.

Layer 60 is a foamed wadding layer. The wadding could be of any foam, fibre or elastic material that provides an opposing force to press against the edge 29 of the container on which the closure is to be sealed. Selection of appropriate wadding is important in providing an adequate seal. The wadding material may be a foamed PE. This wadding material layer could have the hydrogen generator component incorporated through it during the manufacturing process. Azodicarbonamide or sodium-bicarbonate are common blowing agents which could be used to produce the foamed wadding layer. The density of the foam could be adjusted by altering the amount of foaming agent added or the heat settings at which the material is processed and hence the reaction takes place. It would also be possible to use an EVA foam in this layer.

The location, thickness and composition of the wadding layer 60 modifies the hydrogen gas release properties from the active layer (e.g. it may act as a control means as hereinbefore described).

Figure 7:
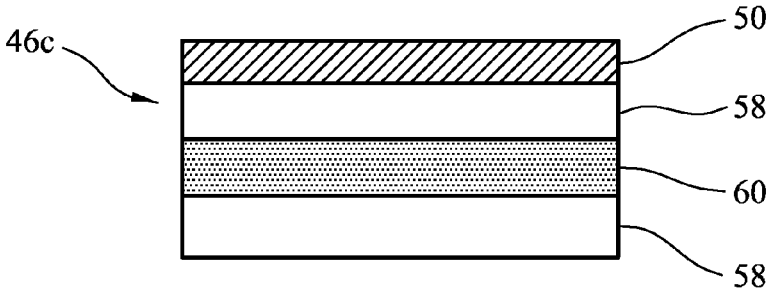
Figure 8:
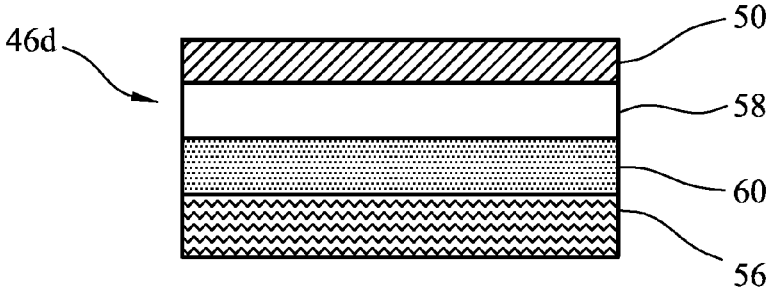

The arrangements of FIGS. 7 and 8 includes other combinations of layers 50, 56, 58 and 60.

Figure 9:
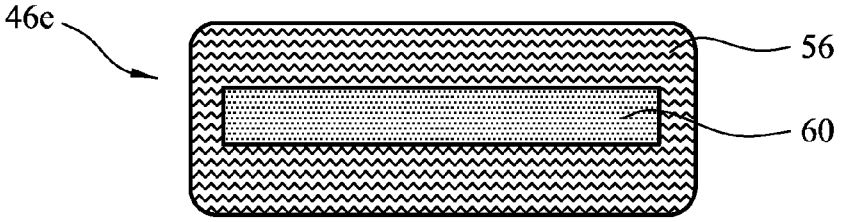

The arrangement of FIG. 9 includes other combinations of layers 56 and 60. This arrangement may be used as a container insert which may be fixed to the container wall. The arrangement of FIG. 10 includes other combinations of layers 50, 58 and 60.

The liners 46*a* to 46*d* may be made by co-extrusion to form sheet materials from which disc-shaped (or other shaped as appropriate) liners may be punched out. It is preferred that adjacent layers are compatible so they may adhere to one another during co-extrusion. If the layers are not compatible, appropriate tie layers may be used leading to structures with an increased number of layers.

The closures and liners of FIGS. 4 to 10 are suitably for use with wine bottles. The closure itself may be modified from that shown in FIG. 4 to include a depending skirt 62 (FIG. 11) which is attached to body 42 via a circumferential weakened portion 64. The FIG. 11 closure is fitted to a bottle so that the body 42 can be unscrewed from the bottle so as to break the weakened portion and leave the skirt, which is restricted from moving by cooperation with part of the bottle neck, in position on the bottle.

The body 42 and/or skirt 62 may be made from metal and/or plastics.

Closures for aseptic and hot fill applications have different requirements to those needed in wine applications. The closures tend to be much wider (33-43 mm) and the industry has moved away from liners in the closures. One reason for this was due to issues with sterilising the closures because the space behind the liner provided an opportunity for the sterilisation medium to remain present in the system. A further reason was to avoid the expense of having a separate liner material.

A variety of closure designs have been developed in order to provide adequate sealing without the need for a liner material, as described below with reference to FIGS. 12 to 16.

In the FIGS. 12 to 16 embodiments, the active materials are secured to the interior of the cap by compression moulding or multistep injection moulding the active matrix compound into the closure shell in situ. The molded design may be a mono- or multi-layer design.

Figure 12:
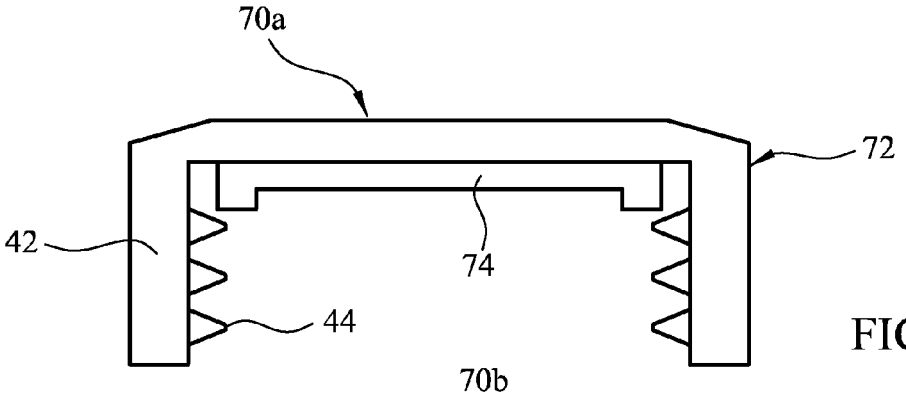

FIG. 12 shows a closure 70*a* comprising a closure shell 72 into which a compression molded liner 74 has been inserted. The liner 74 has active material incorporated into a thermoplastic elastomer which is typically used in such applications e.g. SEBS. The active material (which is suitably a hydride) may be added as a dispersion in oil. The oil used may be used to modify the physical characteristics and 'softness' of the SEBS. The advantage of this approach is that the liner can be molded on standard compression molding equipment with minimal operational changes.

Figure 13:
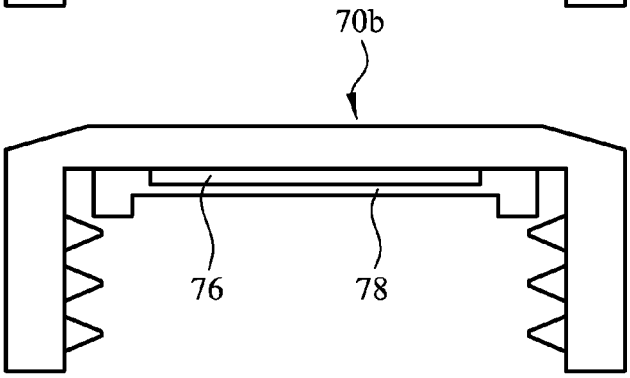

FIG. 13 shows an over-molded dual compression design. A thermoplastic elastomer such as SEBS is the matrix polymer used in both layers 76, 78. However, the active first layer or insert 76 (which incorporates a hydride) could be made from an alternative polymer matrix such as LDPE. The outer layer 78 should be made from a compressible material, in order to retain the sealing characteristics against edge 29 of the container.

The insert 76 is molded first, followed by a second stage where the over-layer 78 is molded. An advantage of this design is that the active hydride material in layer 76 is protected by a functional barrier in layer 78. The thickness and composition of the first layer 76 controls the hydrogen release rate and hence shelf-life.

Figure 14:
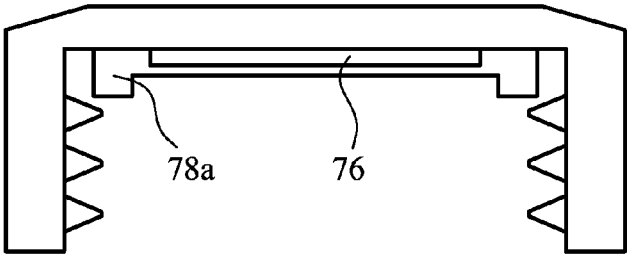

FIG. 14 is similar to FIG. 13 except that a catalyst component is incorporated into the overmolded layer 78*a*. In this case, the rate determining step for hydrogen evolution is a function of moisture ingress to the active insert 76. Reaction between hydrogen and oxygen occurs in the overmolded layer 78*a*.

Figure 15:
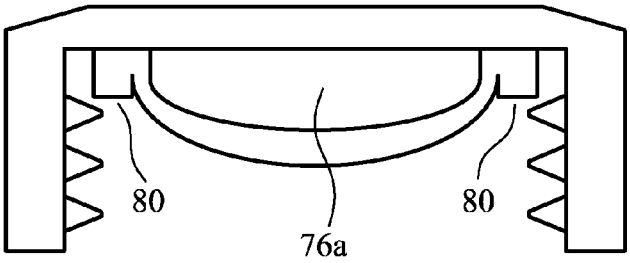

FIG. 15 shows how a compression molding technique is flexible in allowing modification of the central portion 76*a* of the liner construction. The peripheral sealing edge 80 remains the same but the domed shape allows the incorporation of a greater amount of active material into the structure.

Figure 16:
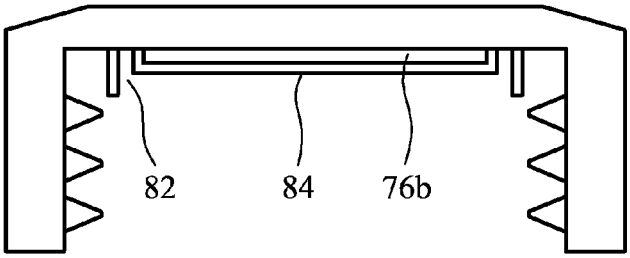

FIG. 16 shows an aseptic closure shell with a sealing 'well' 82. The active material is positioned in a layer 76*b* within the diameter of the sealing well 82. The materials used in this construction must be resistant to the sterilisation process used (typically washing with peracetic acid/hydrogen peroxide solution). Suitably, there are no areas within the design that allow small amounts of the sterilisation medium to remain within the structure to cause contamination to the packaged foodstuff. Furthermore, materials used should not cause contamination of the sterilisation medium. As HDPE is a commonly used material for this style of closure shell, LDPE would be a preferred polymer matrix material for layer 76*b*. The active material in layer 76*b* may be overmolded with a polymer layer 84 to prevent migration.

Figure 17:
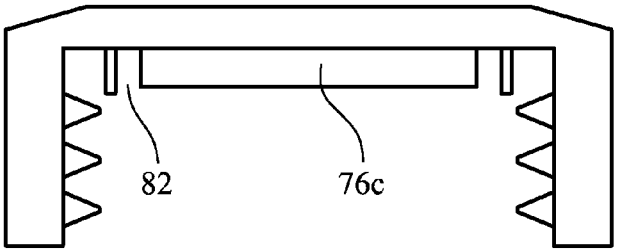

FIG. 17 does not incorporate a functional barrier but includes unprotected layer 76*c* which includes active hydride material within matrix polymer. The arrangement would be used in applications where direct food contact for layer 76*c* was approved.

In the FIGS. 16 and 17 embodiments, the inserts 76 may fully or (as shown in the figures) partially fill the wells 82.

Figure 18:
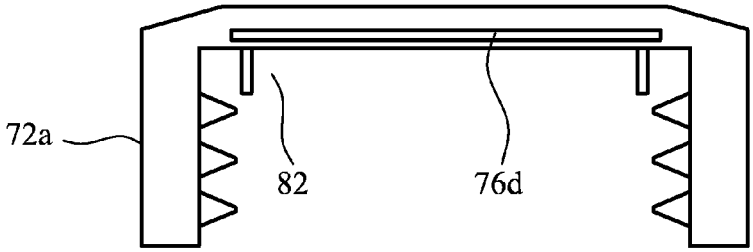

FIG. 18 is a multilayer construction whereby the material of the closure shell 72*a* itself is used as a barrier material. The active material within a matrix is present as a central portion 76*d* within the closure shell construction. The active material is preferably only present in a circular region of the closure shell as the material would be wasted if it were incorporated into the sides of the design.

Figure 10:
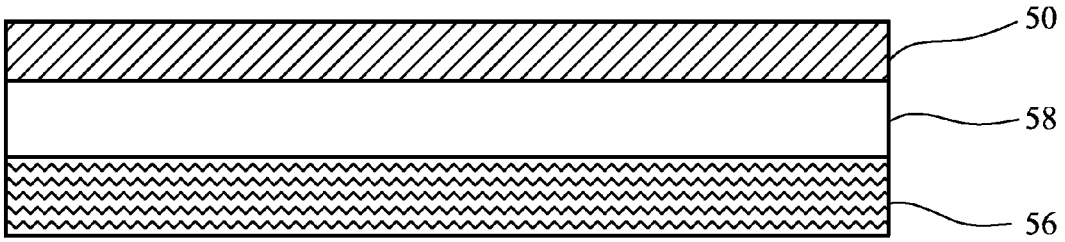
Figure 11:
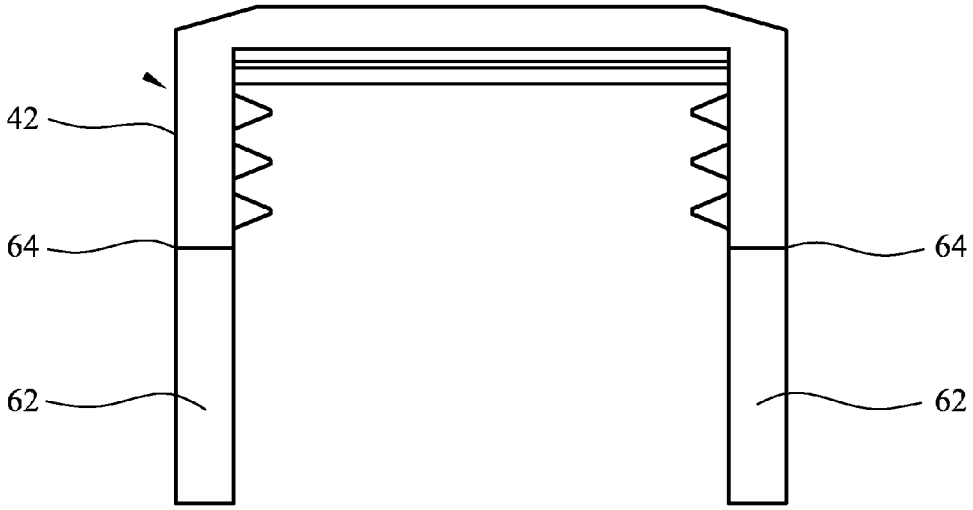
FIGS. 11 to 20 are alternative closures, partly in cross-section.
Figure 19:
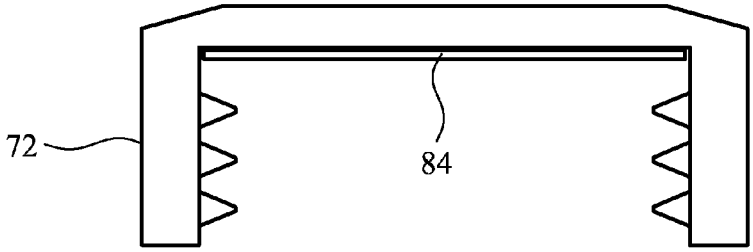
Figure 20:
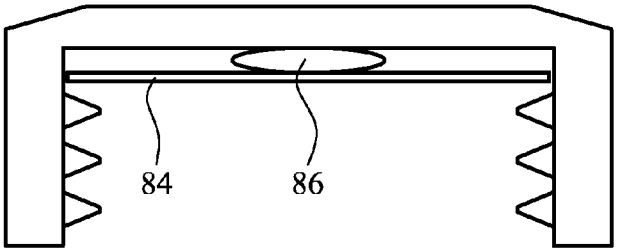

FIGS. 19 and 10 both show designs suitable for the oxygen barrier and carbon dioxide retention properties required for beverages such as beer or carbonated soft drinks. Typically, closures for such applications incorporate pre-molded disks of a barrier polymer such as PVC to prevent $CO_2$ loss. The active hydrogen-generating material can be incorporated into the same liner material 84. FIG. 19 shows such a liner 84 which has been push-fitted into the closure shell 72. FIG. 20 has a similar liner system except that it has been adhered to the closure shell using a suitable adhesive 86.

As an alternative to liners or other structures incorporating active hydrogen generating material being friction or interference fitted into a closure shell, assemblies comprising hydrogen generating material may be fitted in position by other means. For example an upper internal wall of the closure shell may incorporate a projecting threaded bolt which may be arranged to cooperate with an opening defined in an assembly comprising hydrogen generating material in order to screw-threadedly secure the assembly in position.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A closure for a container body, the closure comprising a hydrogen generating means which includes an active material arranged to generate molecular hydrogen on reaction with moisture, wherein said hydrogen generating means comprises a matrix material in which said active material is embedded, wherein said hydrogen generating means is in combination with a control means for controlling passage of moisture to the hydrogen generating means, wherein said control means is arranged to control passage of moisture so as to reduce the rate of hydrogen generation by said hydrogen generating means compared to the rate in the absence of said control means, wherein said control means comprises a layer of material having a water vapour permeability of less than 2.0 g.mm/m$^2$.day, and wherein said hydrogen generating means is capable of generating hydrogen for a period of time of at least 1 month.

2. A closure as claimed in claim 1, wherein said control means comprises a plurality of layers which are secured to one another and make face to face contact.

3. A claim according to claim 1, wherein the rate of passage of moisture through the control means, towards the hydrogen generating means, is slower than the rate of passage of water through said matrix material of said hydrogen generating means.

4. A closure according to claim 1, wherein the ratio of the permeability in g.mm/m$^2$.day of the control means to the water permeability of the matrix material is 1 or less.

5. A closure according to claim 1, wherein the control means comprises a material which has a water vapour permeability in g.mm/m$^2$.day which is less than the water vapour permeability of a polymeric matrix material present in the greatest amount in said matrix material.

6. A closure according to claim 1, the control means defines the rate determining step for passage of moisture to the active material of the hydrogen generating means.

7. A closure according to claim 1, wherein said hydrogen generating means has a length of at least 20 mm.

8. A closure according to claim 1, wherein said matrix material comprises a polymeric matrix material selected from polyolefins, low density polyethylene, high density polyethylene, polypropylene, styrene-ethylene-butylene (SEBS) copolymers, Nylon 6, styrene, styrene-acrylate copolymers and ethylene vinyl acetate.

9. A closure for a container body, the closure comprising a hydrogen generating means which includes an active material arranged to generate molecular hydrogen on reaction with moisture, wherein said hydrogen generating means comprises a matrix material in which said active material is embedded, wherein said hydrogen generating means is in combination with a control means for controlling passage of moisture to the hydrogen generating means, wherein said control means is arranged to control passage of moisture so as to reduce the rate of hydrogen generation by said hydrogen generating means compared to the rate in the absence of said control means, wherein said control means comprises a polymeric material selected from HDPE, PP, LDPE, PET, EVA, SEBS and Nylon, and wherein said hydrogen generating means is capable of generating hydrogen for a period of time of at least 1 month.

10. A closure as claimed in claim 9, wherein said control means comprises a plurality of layers which are secured to one another and make face to face contact.

11. A closure according to claim 9, wherein the rate of passage of moisture through the control means, towards the hydrogen generating means, is slower than the rate of passage of water through said matrix material of said hydrogen generating means.

12. A closure according to claim 9, wherein the ratio of the permeability in g.mm/$m^2$.day of the control means to the water permeability of the matrix material is 1 or less.

13. A closure according to claim 9, wherein the control means comprises a material which has a water vapour permeability in g.mm/$m^2$.day which is less than the water vapour permeability of a polymeric matrix material present in the greatest amount in said matrix material.

14. A closure according to claim 9, wherein the control means defines the rate determining step for passage of moisture to the active material of the hydrogen generating means.

15. A closure according to claim 9, wherein said hydrogen generating means has a length of at least 20 mm.

16. A closure according to claim 9, wherein said matrix material comprises a polymeric matrix material selected from polyolefins, low density polyethylene, high density polyethylene, polypropylene, styrene-ethylene-butylene (SEBS) copolymers, Nylon 6, styrene, styrene-acrylate copolymers and ethylene vinyl acetate.

17. A closure for a container body, the closure comprising a hydrogen generating means which includes an active material arranged to generate molecular hydrogen on reaction with moisture, wherein said hydrogen generating means comprises a matrix material in which said active material is embedded, wherein said hydrogen generating means is in combination with a control means for controlling passage of moisture to the hydrogen generating means, wherein said control means is arranged to control passage of moisture so as to reduce the rate of hydrogen generation by said hydrogen generating means compared to the rate in the absence of said control means, wherein said control means comprises a plurality of layers which are secured to one another and make face to face contact, and wherein said hydrogen generating means is capable of generating hydrogen for a period of time of at least 1 month.

18. A closure according to claim 17, wherein the rate of passage of moisture through the control means, towards the hydrogen generating means, is slower than the rate of passage of water through said matrix material of said hydrogen generating means.

19. A closure according to claim 18, wherein said matrix material comprises a polymeric matrix material selected from polyolefins, low density polyethylene, high density polyethylene, polypropylene, styrene-ethylene-butylene (SEBS) copolymers, Nylon 6, styrene, styrene-acrylate copolymers and ethylene vinyl acetate.

20. A closure according to claim 17, wherein the ratio of the permeability in g.mm/$m^2$.day of the control means to the water permeability of the matrix material is 1 or less; and said control means defines the rate determining step for passage of moisture to the active material of the hydrogen generating means.

* * * * *